US007290539B2

(12) United States Patent
Maeda et al.

(10) Patent No.: US 7,290,539 B2
(45) Date of Patent: Nov. 6, 2007

(54) AIR GUN CARTRIDGE ATTACHMENT AND DETACHMENT APPARATUS

(75) Inventors: Tetsuo Maeda, Tokyo (JP); Yoshiyuki Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 65 days.

(21) Appl. No.: 11/134,375

(22) Filed: May 23, 2005

(65) Prior Publication Data

US 2006/0260596 A1 Nov. 23, 2006

(51) Int. Cl.
*F41B 11/06* (2006.01)

(52) U.S. Cl. ..... 124/74; 124/63

(58) Field of Classification Search ..... 124/61, 124/63, 64, 70–77
See application file for complete search history.

(56) References Cited

U.S. PATENT DOCUMENTS 2,057,169 A * 10/1936 Swenson ..... 42/5
4,219,953 A * 9/1980 Musgrave ..... 42/1.02
4,344,410 A * 8/1982 Curran ..... 124/80
4,614,052 A * 9/1986 Brown et al. ..... 42/87
6,029,645 A * 2/2000 Wonisch et al. ..... 124/74
6,494,194 B2 * 12/2002 Shipachev et al. ..... 124/73

OTHER PUBLICATIONS

Daisy Outdoor Products, Catalog, pp. 12-13 (2002).
Walther 2000 USA, Catalog, p. 13.

* cited by examiner

*Primary Examiner*—Tony Chambers
*Assistant Examiner*—Stewart Knox
(74) *Attorney, Agent, or Firm*—Foley & Lardner LLP

(57) ABSTRACT

An apparatus for installing a high-pressure gas cartridge of this invention comprises: a high-pressure gas cartridge attachment and detachment apparatus for an air gun comprising: a high-pressure gas cartridge housing provided in a clip of an air gun; a back grip panel for a grip formed as a clamp lever; a lever rotation axis constituting a rotation fulcrum for a back grip panel; and a pressing curved surface capable of pressing a bottom part of the high-pressure gas cartridge, wherein a side grip panel of the grip is provided in an attachable and detachable manner so as to open and close the high-pressure gas cartridge housing, the high-pressure gas cartridge may be attached and detached with the back grip panel of the grip rotated about the lever rotation fulcrum so as to be in an open state, and the back grip panel presses against the bottom of the high-pressure gas cartridge due to rotation centered about the lever rotation axis so as to be closed and so as to push up and install the high-pressure gas cartridge A.

5 Claims, 20 Drawing Sheets

Related Art1

Related Art1

Related Art1

Related Art1

Related Art1

Related Art2

Related Art2

Related Art2

Related Art2

Related Art2

AIR GUN CARTRIDGE ATTACHMENT AND DETACHMENT APPARATUS

BACKGROUND OF THE INVENTION

1. Field of Invention

This invention relates to a cartridge attachment and detachment apparatus provided at an air gun clip. Specifically, this invention relates to a high-pressure gas cartridge attachment and detachment apparatus for an air gun capable of attaching a high-pressure cartridge within a clip using a firing energy source of the air gun.

2. Description of the Background Art

In the related art, high-pressure gas used as a firing energy source of an air gun is mostly $CO_2$, with a cartridge filled with $CO_2$ being installed in an air gun for use. A cartridge is then mainly attached to and detached from a clip of an air gun.

That relating to an apparatus for the attachment and detachment of a high-pressure gas cartridge of an air gun of related art 1 and a description of installation of this cartridge is shown in FIGS. 12 to 16. An attachment and detachment apparatus for a high-pressure gas cartridge of an air gun of related art 1 is provided with a grip 101 for an air gun 100. An installation screw 102 is provided at a bottom surface side and a cartridge housing 103 is provided at the inside of the grip 101. A grip panel 104 on the left side of the grip 101 is provided so as to be freely opened and closed.

Next, a description is given according to FIGS. 12 to 16 of a state where the cartridge A is filled with $CO_2$ at the cartridge housing 103 of the air gun 100 of related art 1. FIG. 12 is a front view of the air gun 100. FIG. 13 shows the state when the left side grip panel 104 of the grip 101 is removed from the grip 101. A gap is provided for the cartridge housing 103 within the grip 101, and the installation screw 102 is provided on the bottom surface side of the grip 101.

The installation screw 102 is provided with a projection 102*b* with a lower part exposed to the outside and passes through the bottom surface of the grip 101 due to a screw section 102*a*. The upper part is provided with a cartridge pressing section 105 positioned within the cartridge housing 103. The installation screw 102 is provided in a vertical direction of the grip 101 so as to move up and down with respect to the grip 101 as a result of rotation of the screw. Rotation of the installation screw 102 is such that rotation is caused by an operator pulling the projection 102*b* with their finger.

The cartridge pressing section 105 is a plate-shaped body positioned fixed to the upper end of the installation screw 102 at the bottom side of the gap of the cartridge housing 103. The center of the upper surface of the cartridge pressing section 105 has a shape corresponding to the bottom surface of the high-pressure gas cartridge A so as to form a sunken spherical shape.

The high-pressure gas cartridge A shown in FIG. 14 is inserted into the cartridge housing 103. FIG. 15 is a cross-sectional illustration of the essential parts of the state when the high-pressure gas cartridge A is housed in the cartridge housing 103. In FIG. 16, the installation screw 102 is rotated so as to push up the cartridge pressing section 105, and the high-pressure gas cartridge A is pushed up within the cartridge housing 103. The tip of the upper end of the high-pressure gas cartridge A is pushed by the tip of a pierce 106 of the air gun 100 so that the cartridge A is opened up by the pierce 106. High-pressure gas ($CO_2$) is then sent into an air chamber of the air gun 100. The cartridge A is installed in the cartridge housing 103 from above with the cartridge pressing section 105 in a state of being pushed up and this then constitutes firing energy apparatus of the air gun 100.

This procedure is then reversed in the event of extracting the cartridge A from the cartridge housing 103. Namely, the installation screw 102 is rotated in the opposite direction, the cartridge pressing section 105 is lowered, and the high-pressure gas cartridge A is extracted from the cartridge housing 103 so as to make a space.

However, in related art 1, a substantial amount of time is required to rotate the dial 102*b* of the installation screw 102 every time the high-pressure gas cartridge A is changed. The operation of changing the high-pressure gas cartridge A is extremely time-consuming and the operation itself is difficult. At the attachment and detachment apparatus for the high-pressure gas cartridge of the air gun of related art 1, the installation screw 102 is normal in a state projecting from the bottom surface of the grip 101. This makes handling difficult and is also unsuitable with regards to the external design of an air gun.

Next, that relating to an apparatus for the attachment and detachment of a high-pressure gas cartridge of an air gun of related art 2 and a description of installation of this cartridge is shown in FIGS. 17 to 21. The apparatus for the attachment and detachment of a high-pressure gas cartridge for an air gun is comprised of a clamp lever 202 incorporated at a bottom panel provided at the grip 201 of the air gun 200 and an adjustment screw base 203 that is separate from the clamp lever 202. Numeral 201*a* is a right-side grip panel, numeral 209 is a cartridge housing, and P is a pierce tip.

A clamp lever 202 is provided with a base pressing projection 202*a*, of a length substantially matching with the length of the bottom surface, provided at the bottom surface side of the grip 201 in such a manner as to press the adjustment base 203 in the vicinity of a lever rotation axis 204, with one end supported in a freely rotating manner at the lever rotation axis 204 constituting a rotation fulcrum. The base pressing projection 202*a* comes into contact with a recess 203*a* of the adjustment base 203.

The adjustment base 203 is provided at the bottom surface side of the grip so as to be long in a lengthwise direction of the bottom surface with one end supported in a freely rotating manner at an adjustment screw base rotation axis 205 positioned on the opposite side to the lever rotation axis 204 of the clamp lever 202. The adjustment base 203 is provided with a stroke adjustment screw 207 for adjusting the position of a cartridge pressing section 206 at the center, with the other end being urged in the direction of the bottom surface of the grip by the spring 208.

Next, a description is given of an operation for housing the high-pressure gas cartridge A in a cartridge housing 209 for an attachment and detachment apparatus for a high-pressure gas cartridge for an air gun of related art 2 based on FIGS. 18 to 21 constituting enlarged illustrations of a grip 201 of an air gun 200. FIG. 18 shows a state where the clamp lever 202 constituted by a bottom surface panel is rotated taking the lever rotation axis 204 as a fulcrum so as to open up the bottom surface. A side panel for a grip 201 (not shown) is removed, and the cartridge housing 209 is opened up. In FIG. 19, the high-pressure gas cartridge A is stored in the cartridge housing 209, the stroke adjustment screw 207 of the adjustment base 203 is rotated, and the position of the cartridge pressing section 206 is pushed up and adjusted so as to substantially make contact with the bottom surface of the high-pressure gas cartridge A. Next, as shown in FIGS. 20 and 21, the clamp lever 202 is rotated taking the lever rotation axis 204 as a fulcrum, and is closed so as to constitute the bottom surface panel (refer to FIG. 21). As a result of this rotation, a base pressing projection 202*a* of the clamp lever 202 fitting with the recess 203*a* of the adjustment base 203 presses the adjustment base 203 up. The adjustment base 203 rotates taking an adjustment screw rotation axis 205 as a fulcrum. As a result of the pushing up of the adjustment base 203, the cartridge pressing section 206 pushes the high-pressure gas cartridge A up and into the cartridge housing 209. The tip of the upper end of the high-pressure gas cartridge A is pushed by the tip of a pierce P of the air gun 200 so that the high-pressure cartridge A is opened up by the pierce P. High-pressure gas ($CO_2$) is then sent into an air chamber of the air gun 200.

Next, in the event of extracting the high-pressure gas cartridge A in related art 1, the clamp lever 202 constituting a bottom surface panel is rotated taking the lever rotation axis 204 as a fulcrum so as to open up the bottom surface. In doing so, the adjustment base 203 is rotated in the direction of the bottom surface taking the adjustment screw rotation axis 205 as a fulcrum due to the urging force of the spring 208. Next, the stroke adjustment screw 207 is made to rotate so that the position of the cartridge pressing section 206 is lowered so as to come away from the bottom surface of the high-pressure gas cartridge A. The high-pressure gas cartridge A is then extracted from the cartridge housing 209.

Because the clamp lever 202 constitutes the bottom surface panel, the apparatus for attaching and detaching the high-pressure gas cartridge of the air gun of related art 2 is shorter than the length of the bottom surface of the grip. It is therefore not possible to make the lever operation force of the clamp lever 202 large. Because of this, a comparatively large force is required to open and close the clamp lever 202 and it is therefore difficult for an elderly person or female to carry out an operation for changing the high-pressure gas cartridge.

Further, there is also the problem that the distance (moveable range) moved in the vertical direction by the cartridge pressing section 206 is small due to the lever action of the clamp lever 202 not being large. In order to cover this kind of defect, in related art 2, the clamp lever 202 is provided with a member referred to as a separate adjustment base 203. The stroke adjustment screw 207 and the cartridge pressing section 206 are provided at the adjustment base 203. The distance of movement of the cartridge pressing section 206 due to rotation of the stroke adjustment screw 207 is adjusted upon the pushing up of the high-pressure gas cartridge A.

The attachment and detachment apparatus of the high-pressure gas cartridge of related art 2 has many members and is complex. In addition, the operation of changing the high-pressure gas cartridge A also requires an operation of rotating a stroke adjustment screw and this operation is also complex.

Further, it is also not possible for the length of the bottom surface of the grip to be longer than normal from a design point of view because of the functions of the air gun.

SUMMARY OF THE INVENTION

An apparatus for attaching and detaching a high-pressure gas cartridge of this invention is comprised of a cartridge housing provided in a clip of an air gun; a back grip panel for a grip formed as a clamp lever; a lever rotation axis provided in the vicinity of a bottom part of the grip and constituting a rotation fulcrum for a back grip panel; and a pressing curved surface capable of pressing a bottom part of the high-pressure gas cartridge.

A side grip panel of the grip is provided in an attachable and detachable manner so as to open and close the cartridge housing, the high-pressure gas cartridge may be attached and detached with the back grip panel of the grip rotated about the lever rotation fulcrum so as to be in an open state, and the back grip panel may press against the bottom of the high-pressure gas cartridge due to rotation centered about the lever rotation axis so as to be closed.

Further, in an attachment and detachment apparatus for a high-pressure gas cartridge of an air gun of a preferred embodiment of the invention, the attachment and detachment apparatus for the high-pressure gas cartridge of the air gun is such that the pressing curved surface capable of pressing the bottom of the high-pressure gas cartridge is comprised of a roller capable of rotation.

BRIEF DESCRIPTION OF THE DRAWINGS

FIG. 1 is a front view of an air gun viewed from the right side. FIG. 2 is a rear view of an air gun. FIG. 3 shows an air gun with a right side grip panel removed. FIG. 4 is a cross-sectional view of the main parts in the state in FIG. 3. FIG. 5 shows a clamp lever constituted by a back grip panel of an air gun rotated so as to be open. FIG. 6 is a cross-sectional view of the main parts for the state in FIG. 5. FIG. 7 shows the situation when the high-pressure gas cartridge is housed in the cartridge housing. FIG. 8 is a cross-sectional view of the main parts in the state in FIG. 7. FIG. 9 shows the situation where the clamp lever constituted by the back grip panel of the air gun is rotated so as to be closed. FIG. 10 is a cross-sectional view of the main parts of the state in FIG. 9. FIG. 11 shows the state with the left side grip panel of the air gun fitted.

FIG. 12 is a left side view of an air gun. FIG. 13 shows the state with the left side grip panel removed. FIG. 14 is a view showing a state where a high-pressure gas cartridge is housed in the cartridge housing of an air gun. FIGS. 15 and 16 are cross-sectional views of the essential parts when a high-pressure gas cartridge is housed in the cartridge housing.

FIG. 17 is a view of an air gun with the right side grip panel removed. FIGS. 18 to 21 are enlarged views illustrating a grip of an air gun.

DESCRIPTION OF THE PREFERRED EMBODIMENTS

Figure 2:
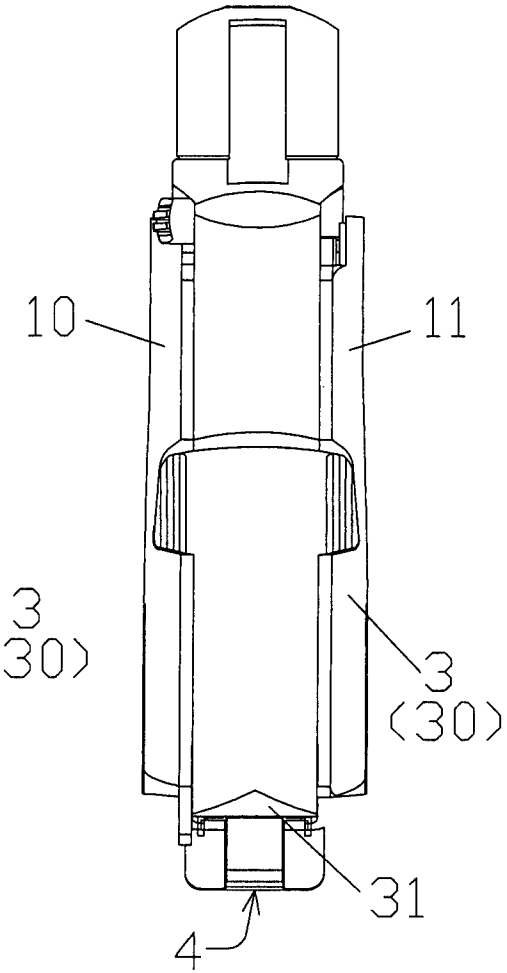
FIGS. 1 to 11 show a first embodiment of a high-pressure gas cartridge attachment and detachment apparatus for an air gun of this invention.

A description is now given of a high-pressure gas cartridge attachment and detachment apparatus of a first preferred embodiment of the invention.

An air gun G fires a pellet using jet pressure of a gas such as compressed air or compressed $CO_2$ as a pressure source for a firing mechanism. High-pressure gas constituting this firing pressure source that in the main is $CO_2$ high-pressure gas is housed under compression in the high-pressure gas cartridge A. This high-pressure gas cartridge A can be stored in an attachable and detachable manner in a cartridge housing 2 constituted by a space provided within a grip 1 of an air gun G.

A high-pressure gas cartridge installation apparatus of an air gun of this invention is comprised of the cartridge housing 2 provided in the grip 1 of the air gun G, a back grip panel 3 of the grip 1 formed as a clamp lever, a lever rotation axis 5 provided in the vicinity of the bottom surface 4 of the grip 1 constituting a fulcrum of rotation of the back grip panel 3, and a pressing curved surface 6 capable of pressing a bottom section A1 of the high-pressure gas cartridge A. In this embodiment, the pressing curved surface 6 is constituted by a rotatable roller 6.

The side grip panel 10 of the grip 1 is provided in an attachable and detachable manner so as to open and close the cartridge housing 2. The back grip panel 3 of the grip 1 is capable of attaching and detaching the high-pressure gas cartridge A in a state of being open as a result of being rotated about the lever rotation axis 5. The back grip panel 3 presses against the bottom section A1 of the high-pressure gas cartridge A due to the action of the back grip panel 3 rotating about the lever rotation axis 5 so as to close, and the high-pressure gas cartridge A is pressed up.

Figure 1:
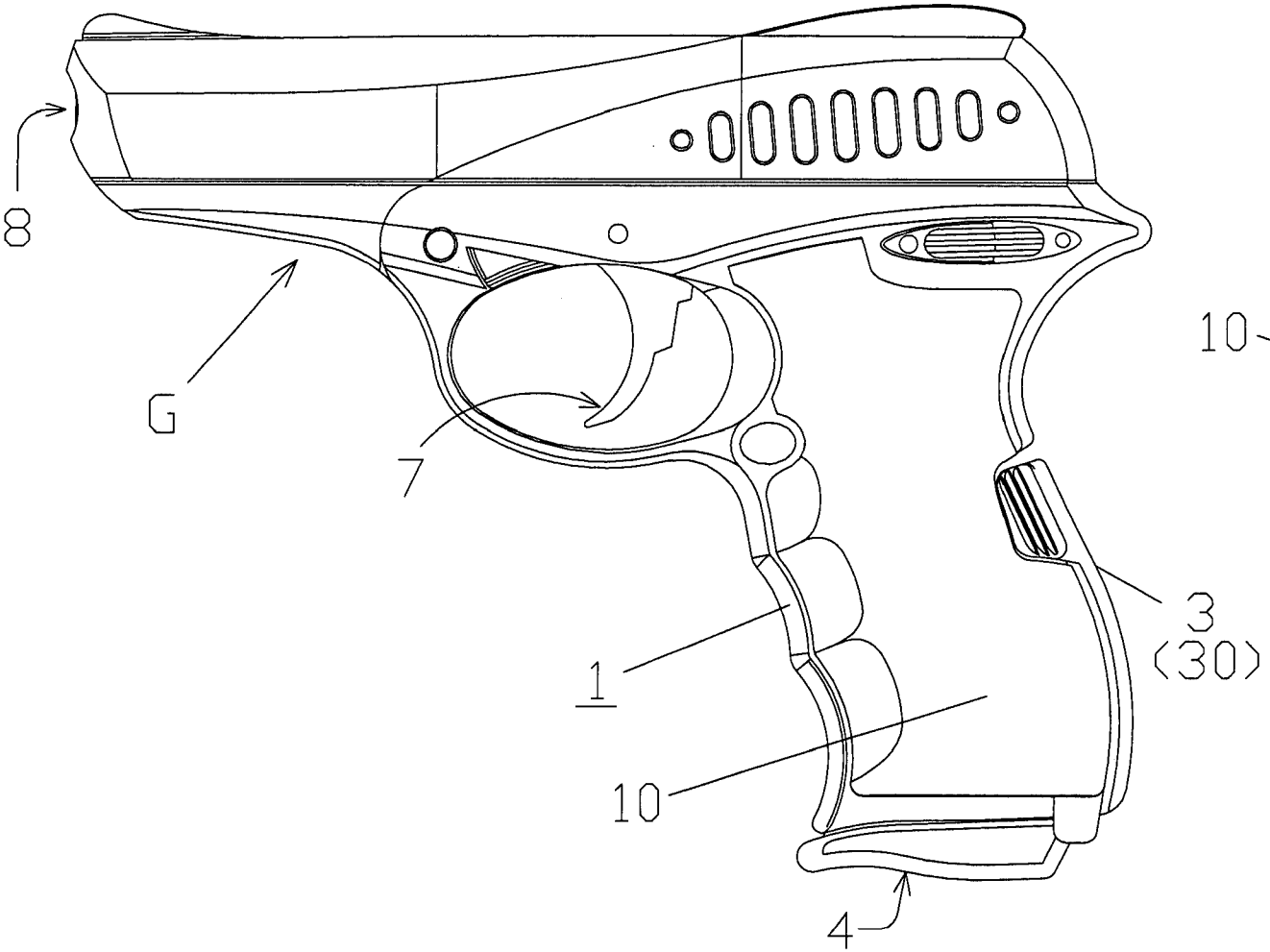
Figure 3:
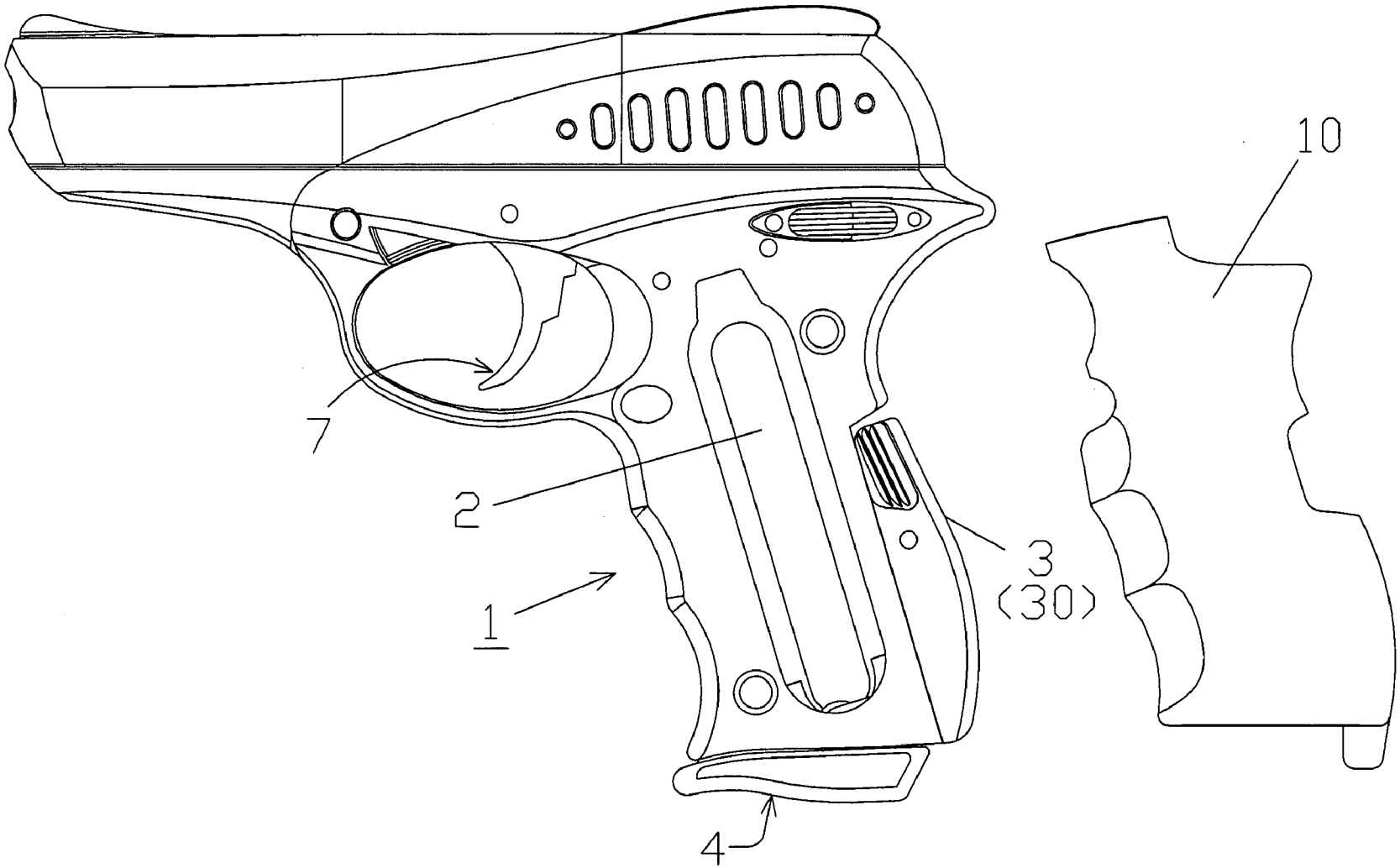
Figure 4:
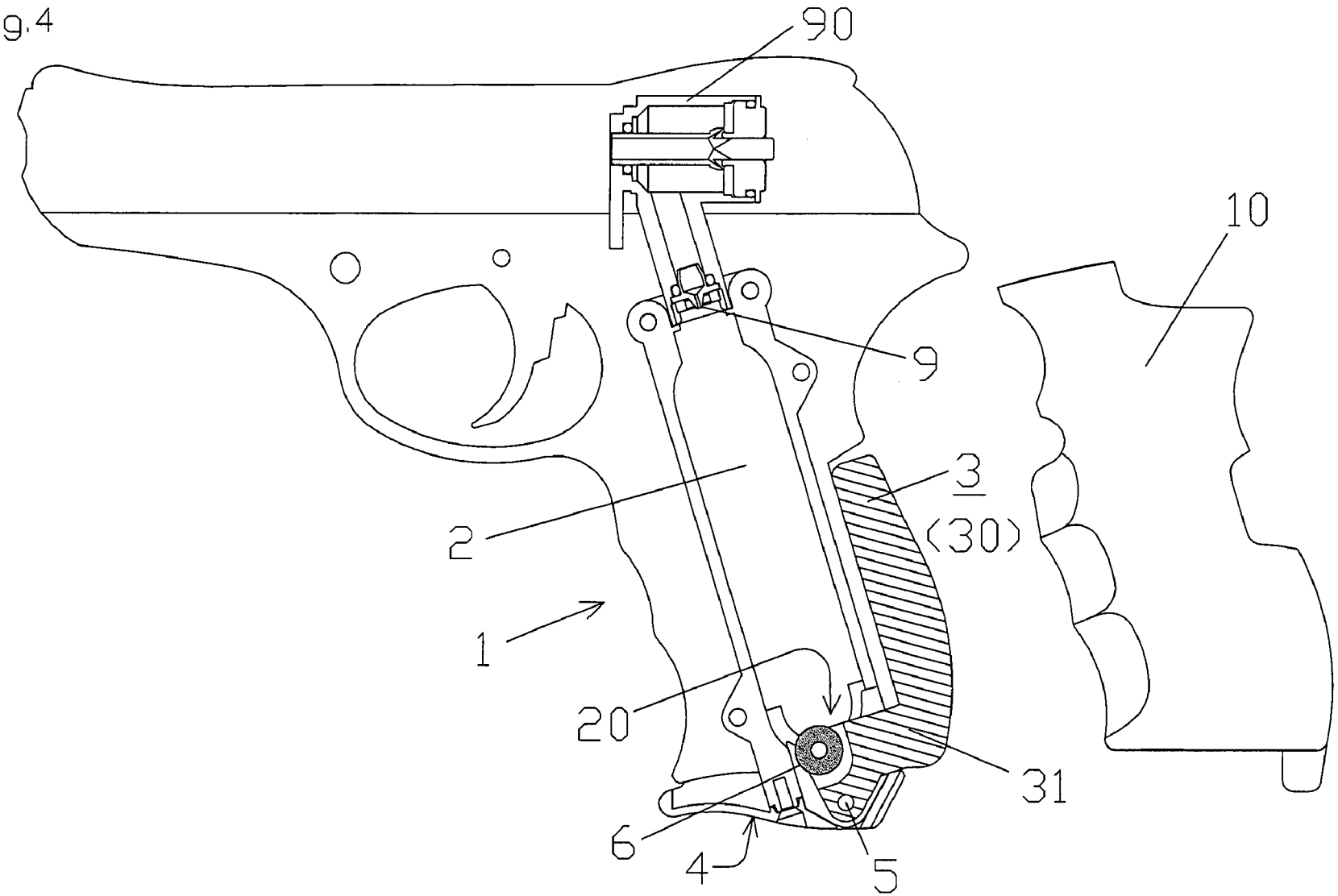

The main parts of an air gun G are shown in FIGS. 1 and 2. Here, numeral 7 is a trigger, and numeral 8 is a muzzle. Numeral 1 is a grip provided at the surface of a left side grip panel 10, right side grip panel 11, back grip panel 3. The left and right side grip panels 10 and 11 are capable of being attached and detached using a screw etc. at the grip 1. In this embodiment, the left side grip panel 10 is provided in an attachable and detachable manner. When the left side grip panel 10 is removed, as shown in FIGS. 3 and 4, the cartridge housing 2 constituted by the space is opened. Numeral 4 shows the bottom surface of the clip 1.

The cartridge housing 2 has a hole 20 with the pressing curved surface 6 moving along the bottom surface coming into contact with the bottom surface of the high-pressure gas cartridge A. The length of the cartridge housing 2 is longer than the length of the high-pressure gas cartridge A.

Figure 5:
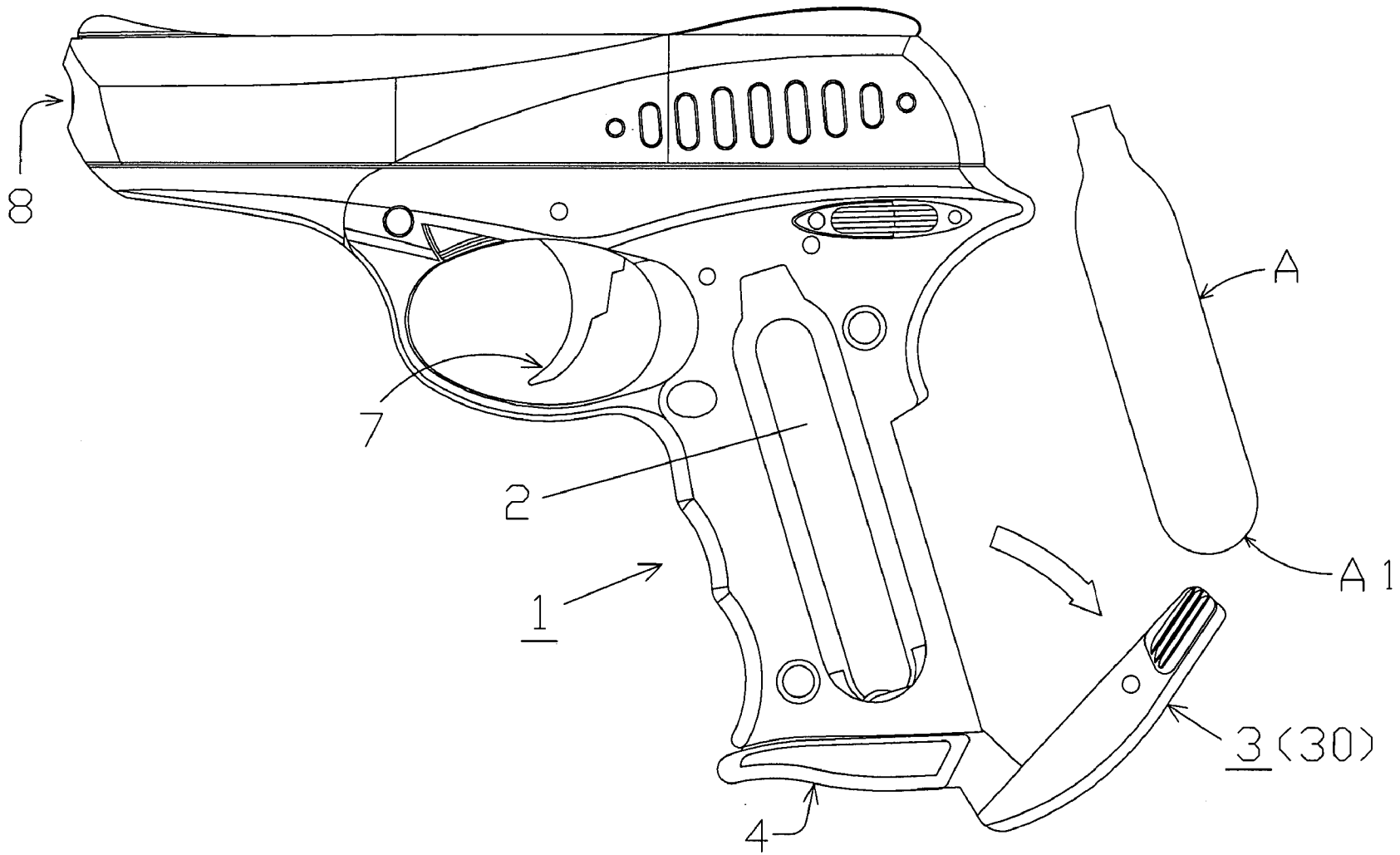
Figure 6:
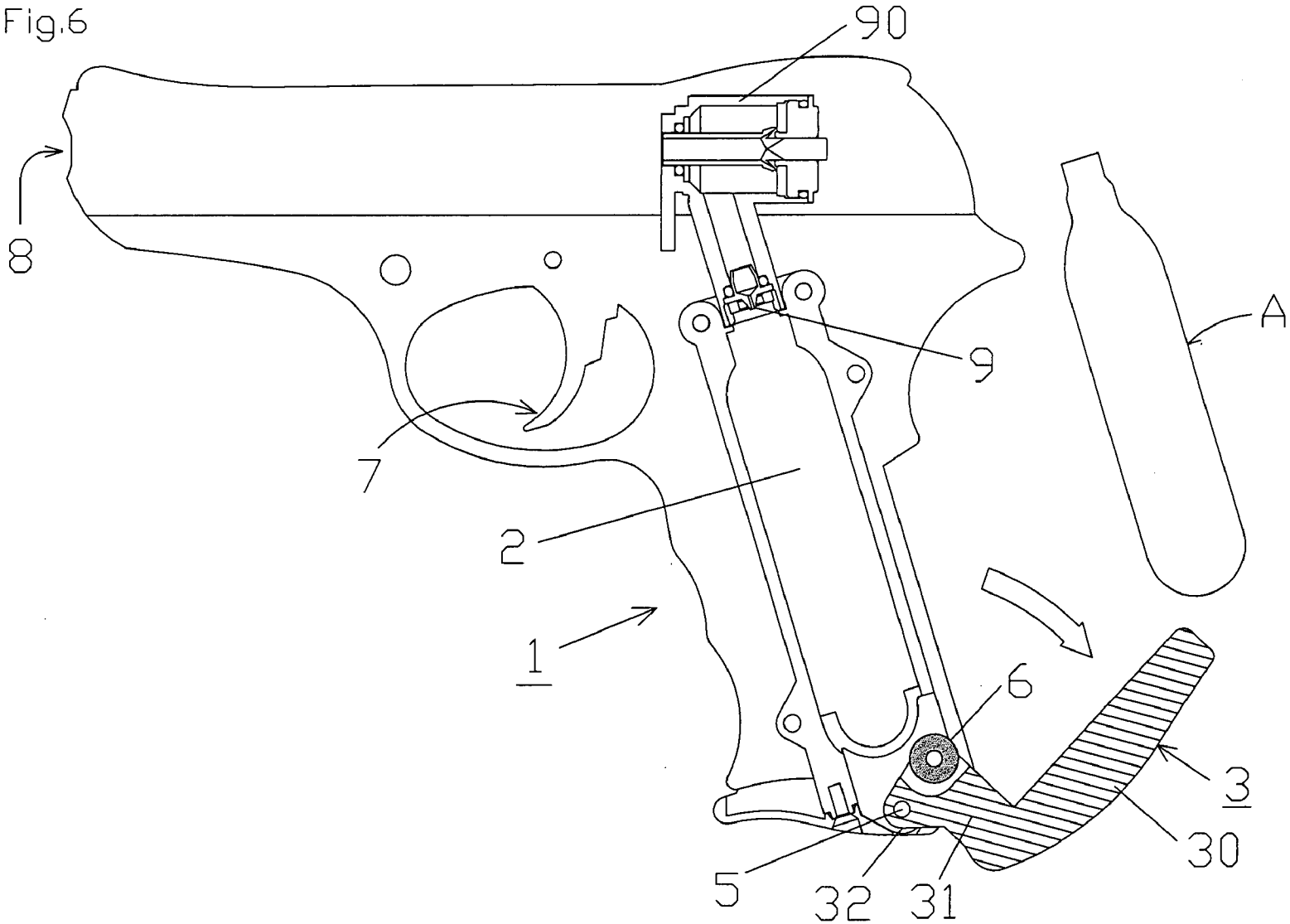

Next, as shown in FIGS. 5 and 6, The back grip panel 3 of the grip 1 is rotated about the lever rotation axis 5 so that the back grip panel 3 becomes in an open state. The back grip panel 3 is comprised of a clamp lever 30 constituted by the back panel and a back grip panel bottom 31 curving at a right angle at the bottom side of the clamp lever 30, so as to constitute an integrated panel in an L-shape with a certain degree of thickness. The back grip panel 3 is provided with a rotating projection 32 at the lower side of the end of the back grip panel button 31 and is coupled in a rotatable manner to the lever rotation axis 5 provided in the vicinity of the bottom surface 4 of the grip 1 by the rotating projection 32. The back grip panel 3 is provided with a freely rotating roller 6 constituted by the pressing curved surface at an angular part at an upper side of the end of the back grip panel bottom 31. The roller 6 is positioned above the grip 1 by the lever rotation axis 5 and rotates together with the clamp lever 30 about the lever rotation axis 5. A further embodiment of the pressing curved surface 6 configured from a columnar member that does not rotate is also possible.

Next, a description is given of the operation of a high-pressure gas cartridge attachment and detachment apparatus of an embodiment of the invention. When the cartridge housing 2 is in the empty state as shown in FIGS. 3 and 4, the roller 6 is inserted from the hole 20 of the cartridge housing 2 into the cartridge housing 2. From the state shown in FIGS. 3 and 4, the clamp lever 30 of the back grip panel 3 is grasped, and is rotated to the rear about the lever rotation axis 5.

In FIGS. 5 and 6, the roller 6 is also rotated to the rear about the lever rotation axis 5 in accompaniment with the rotation of the clamp lever 30 to the rear so as to go from the state in FIG. 4 to the state in FIG. 6. The roller 6 shown in FIG. 6 goes down in a direction of the bottom surface at the rear of the grip 1 and goes out from the inside of the cartridge housing 2.

Figure 7:
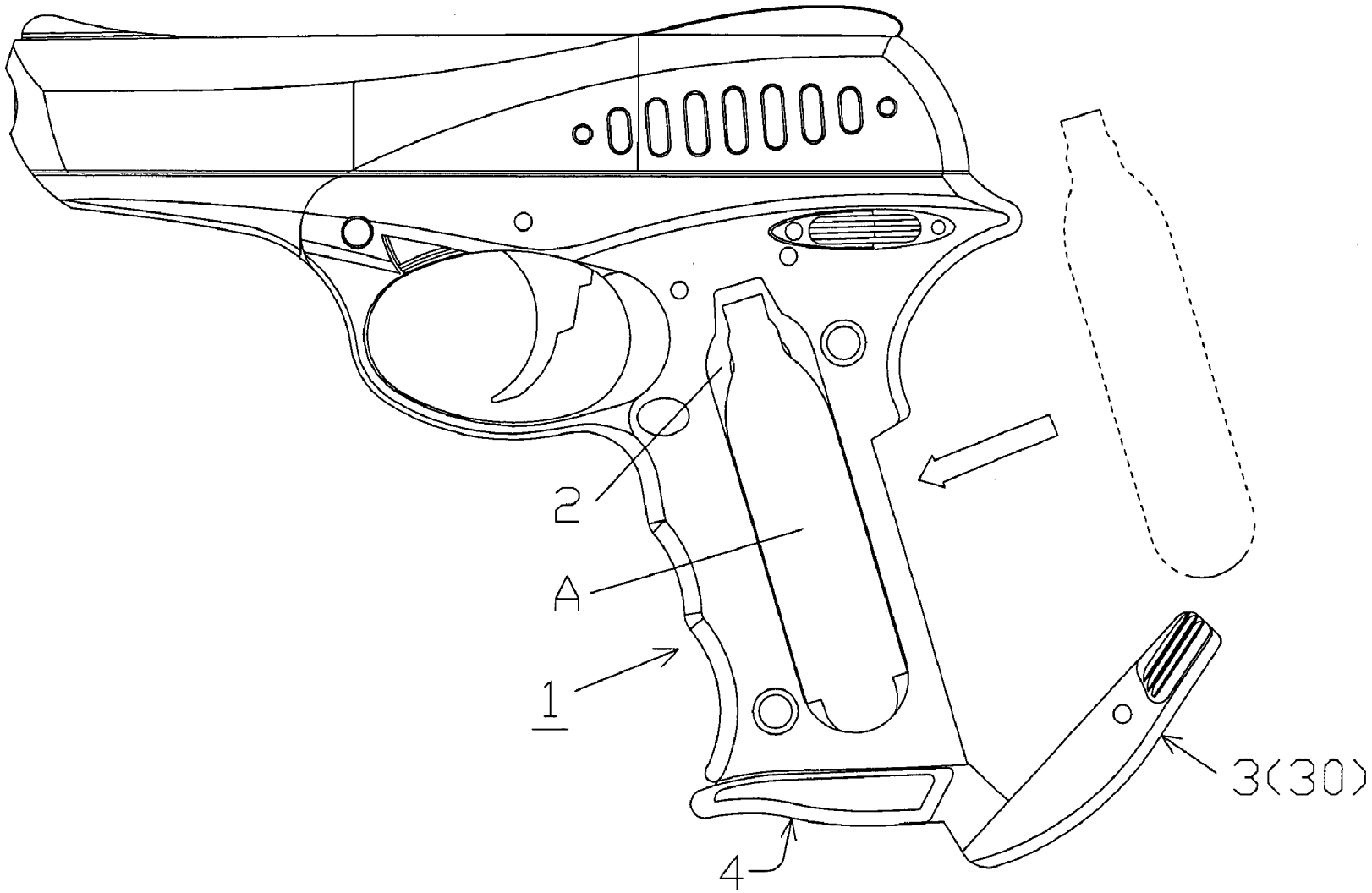
Figure 8:
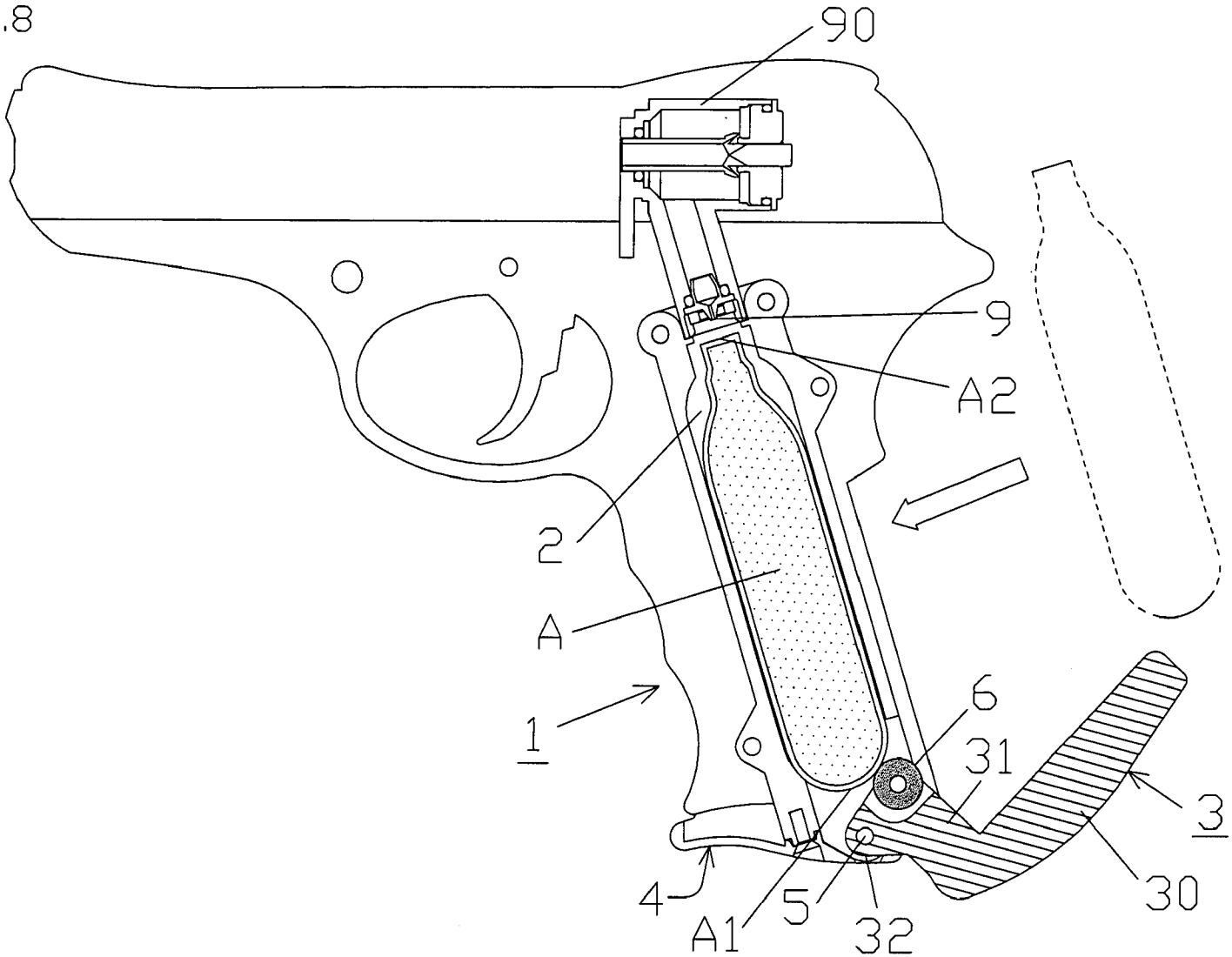

Next, the high-pressure gas cartridge A is housed in the cartridge housing 2 as shown in FIGS. 7 and 8. In this state, the high-pressure gas cartridge A is supported so as to touch the bottom surface of the inside due to its own weight at the center of the cartridge housing 2. In this state, the upper end A2 of the high-pressure gas cartridge A does not touch the pierce 9 of the air gun G. Further, the bottom surface of the high-pressure gas cartridge A is semi-spherical, and touches the roller 6 from substantially the top part of the bottom to an upper position.

Figure 9:
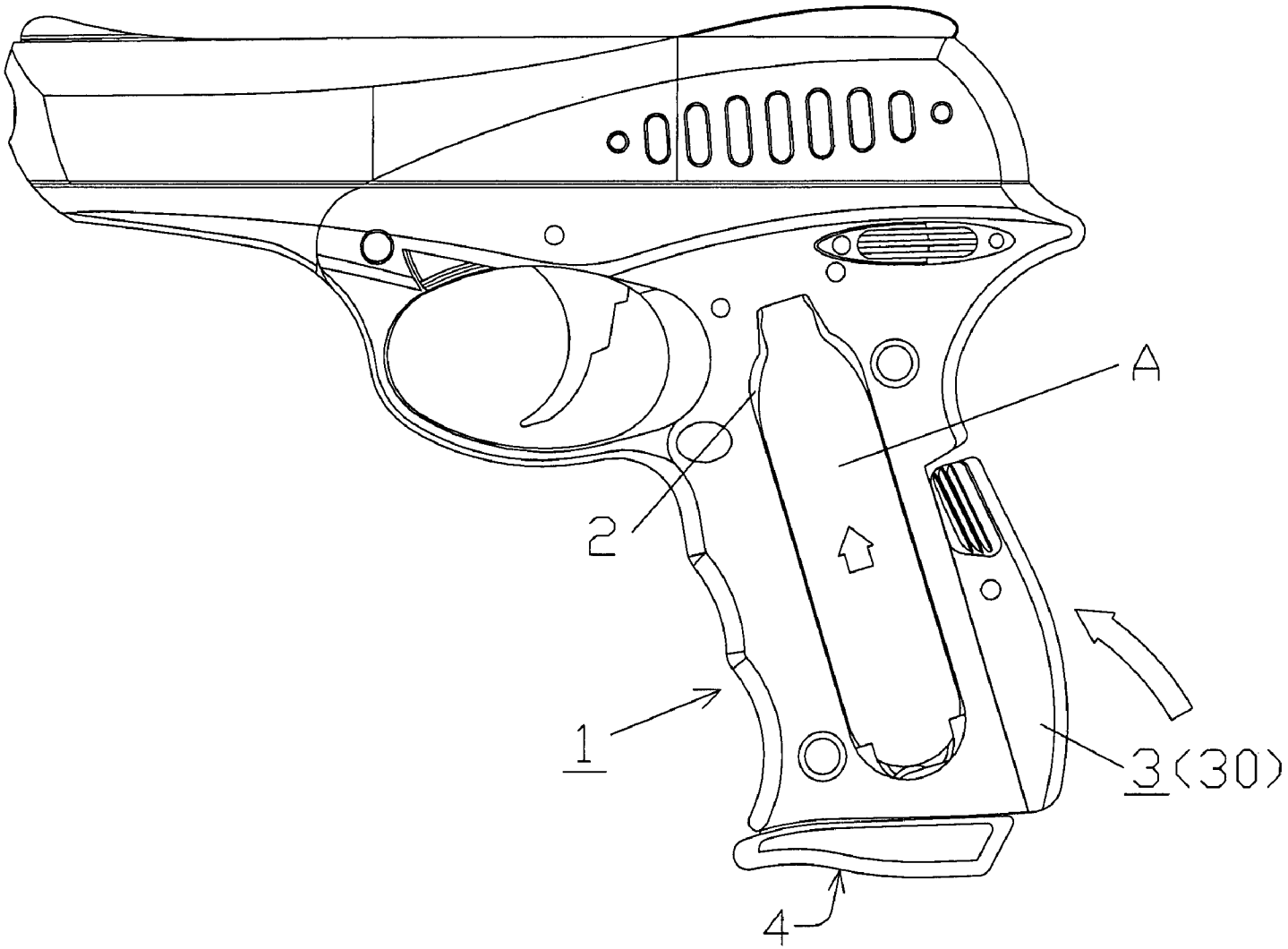
Figure 10:
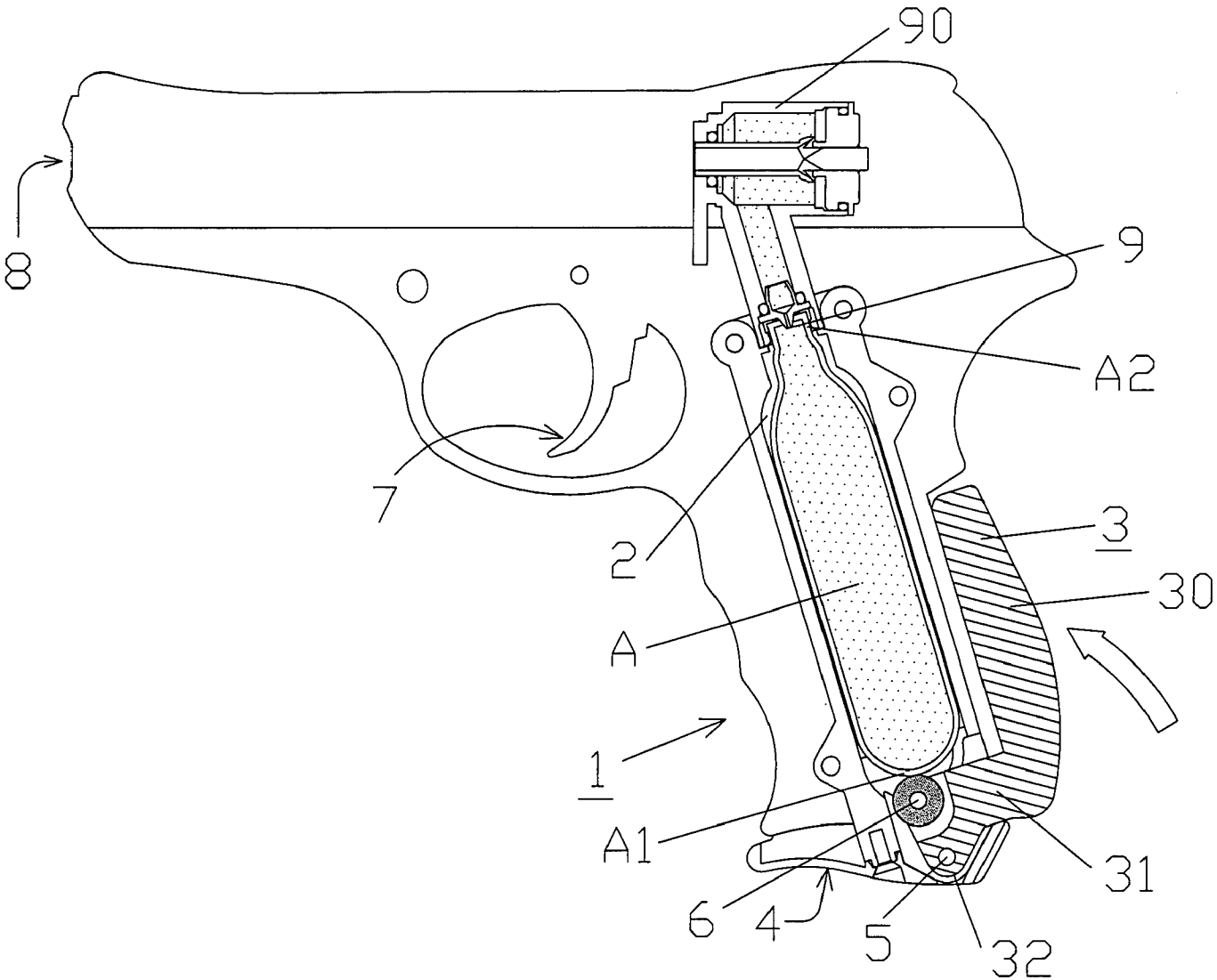
Figure 11:
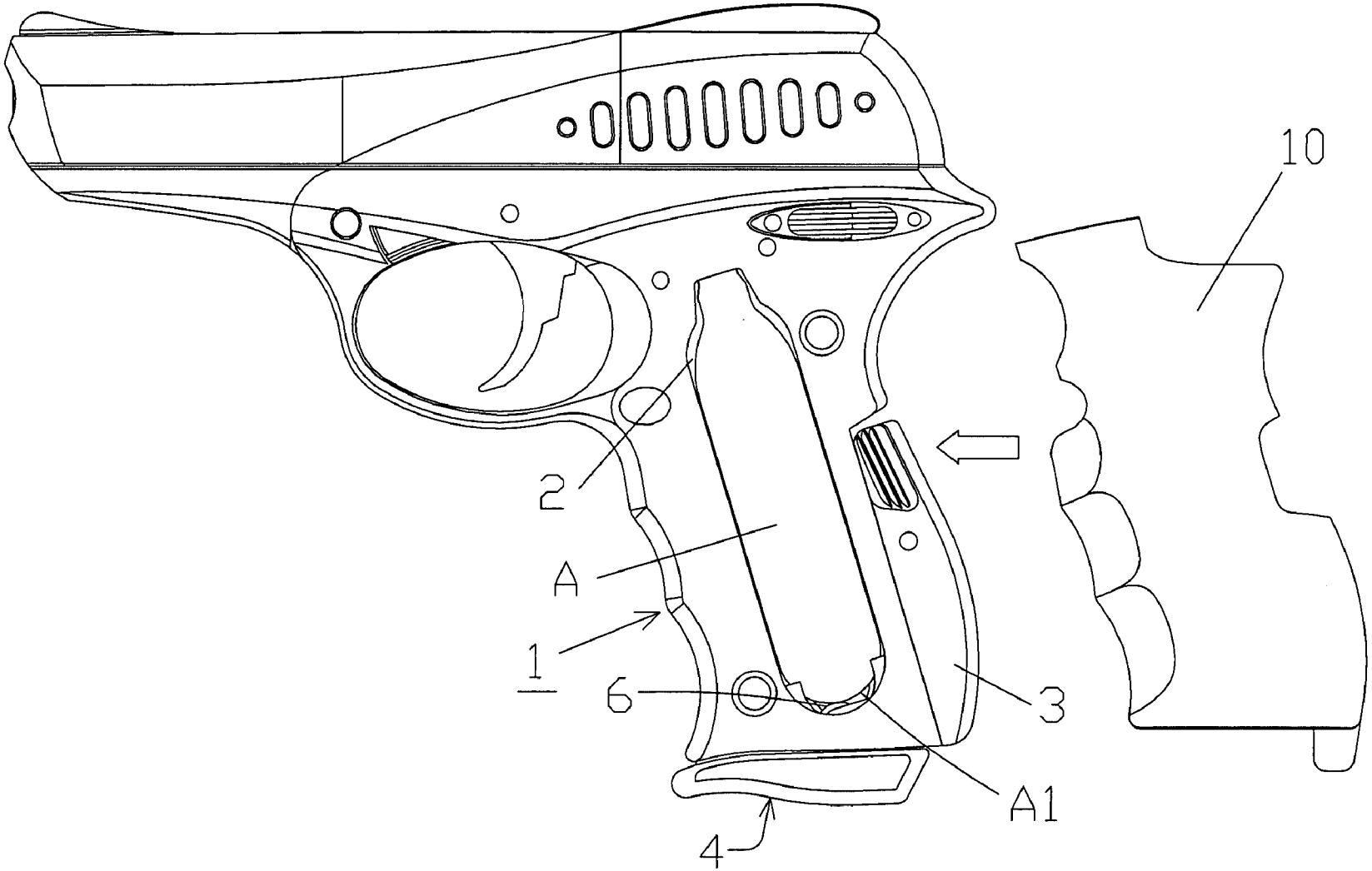
Figure 12:
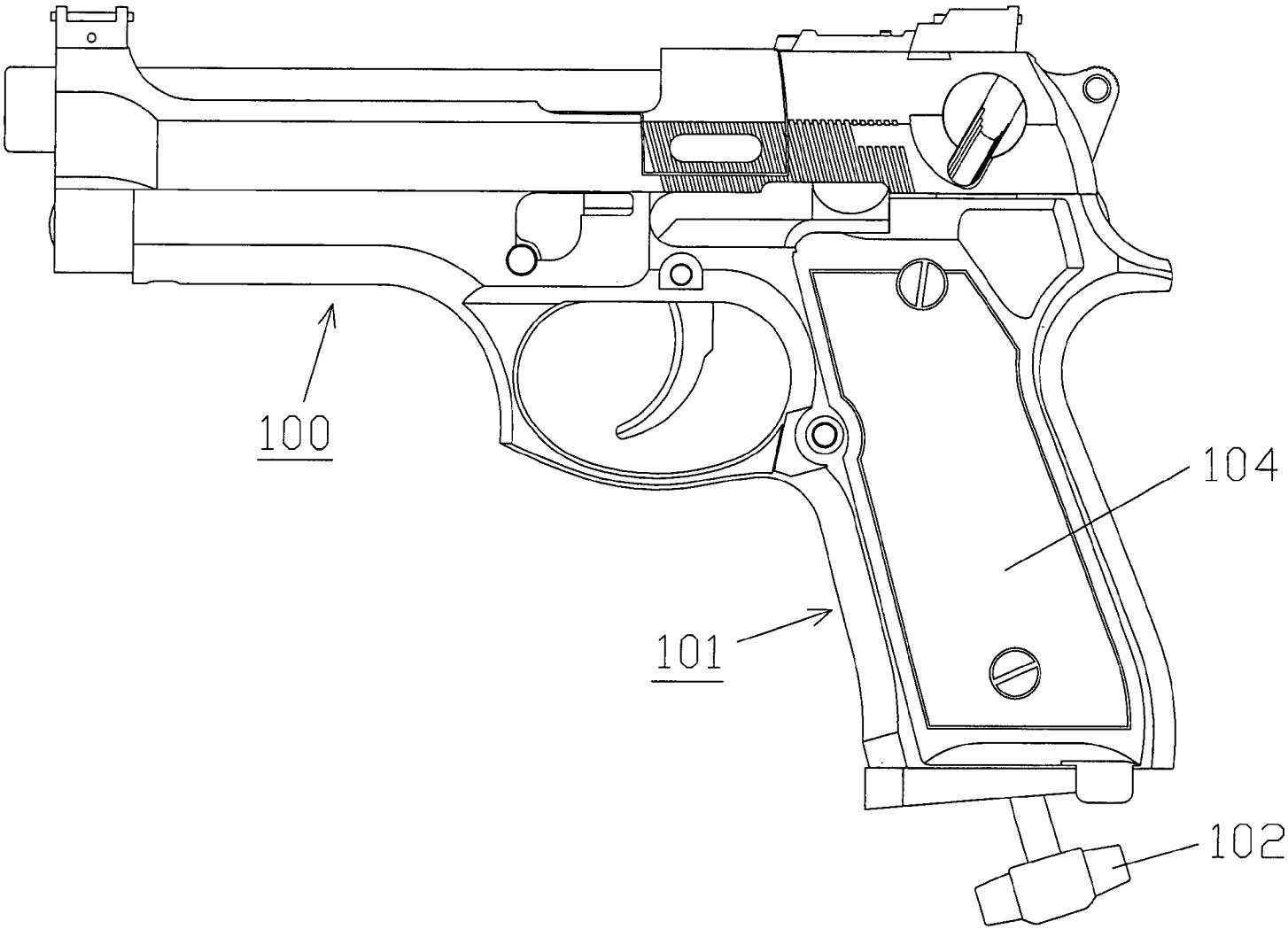
FIGS. 12 to 16 show high-pressure gas cartridge attachment and detachment apparatus relating to related art 1.
Figure 13:
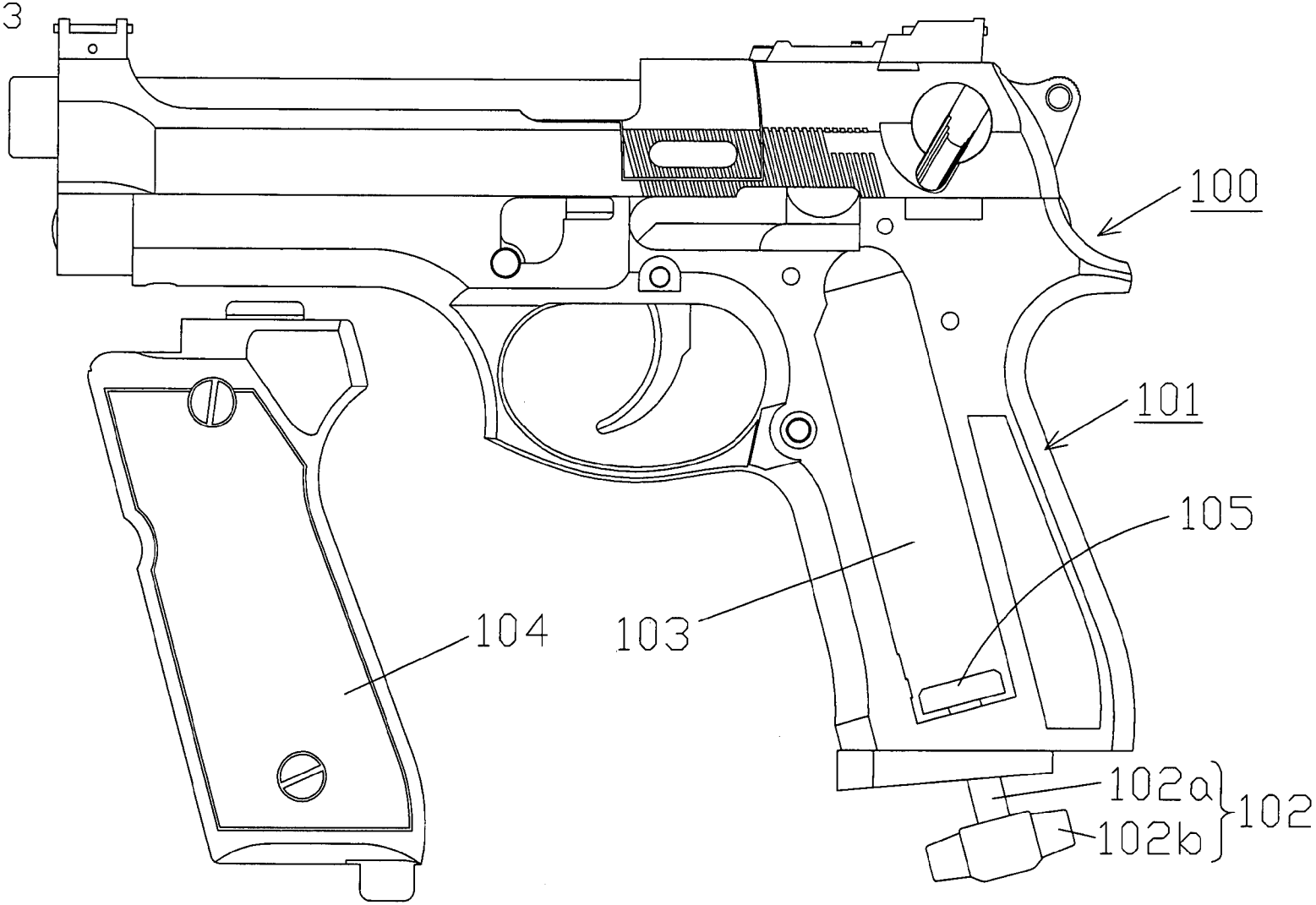
Figure 14:
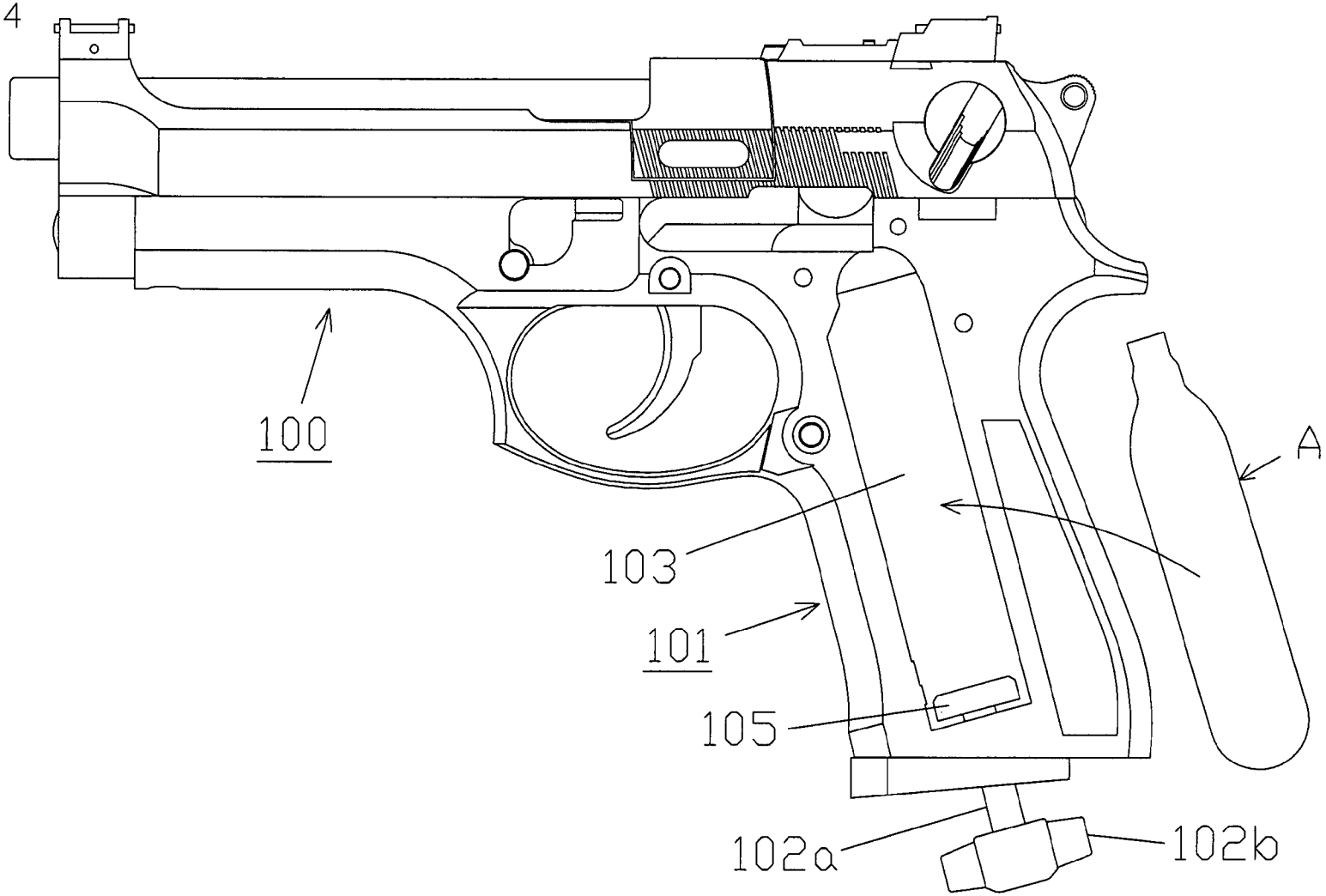
Figure 15:
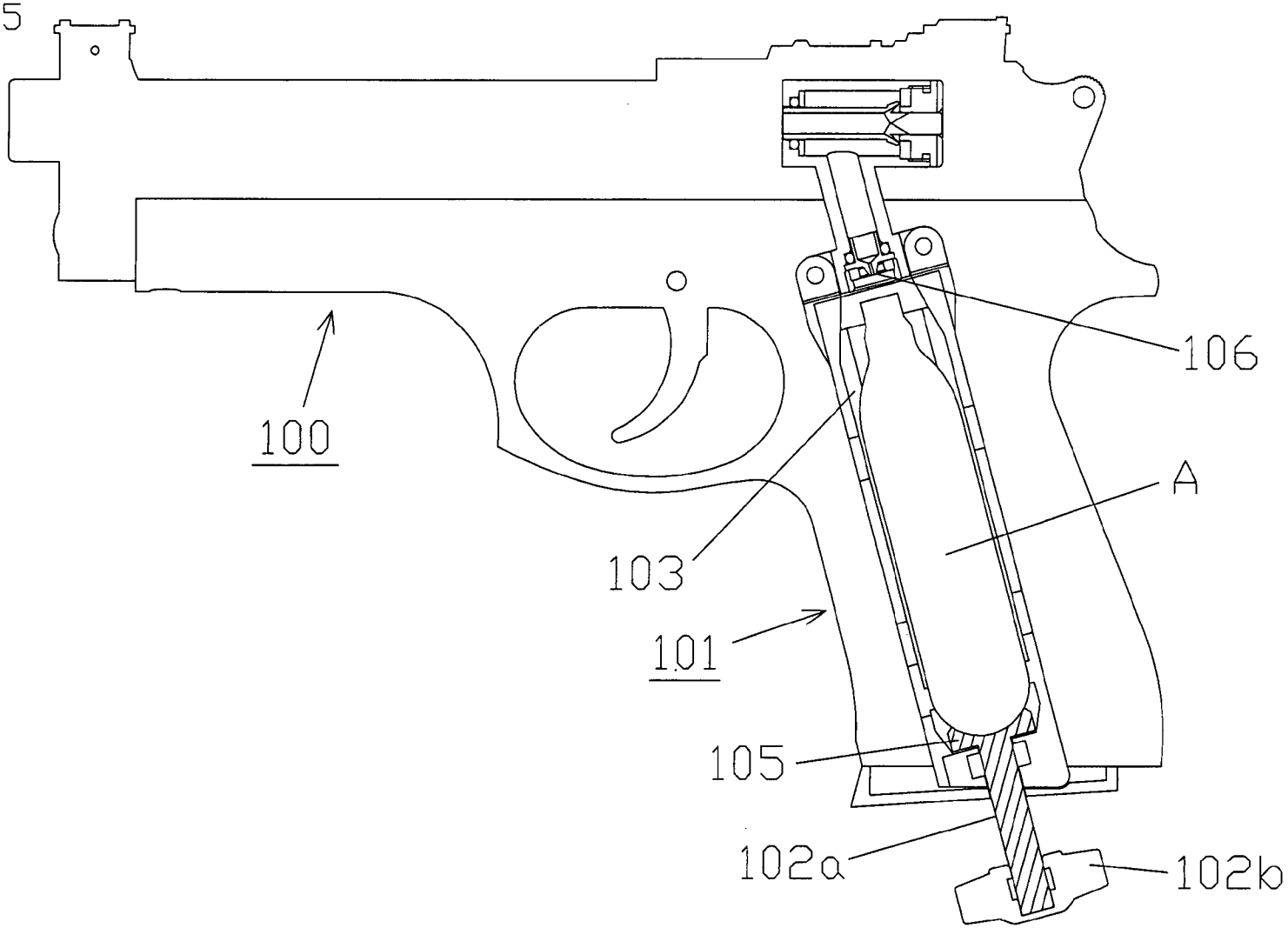
Figure 16:
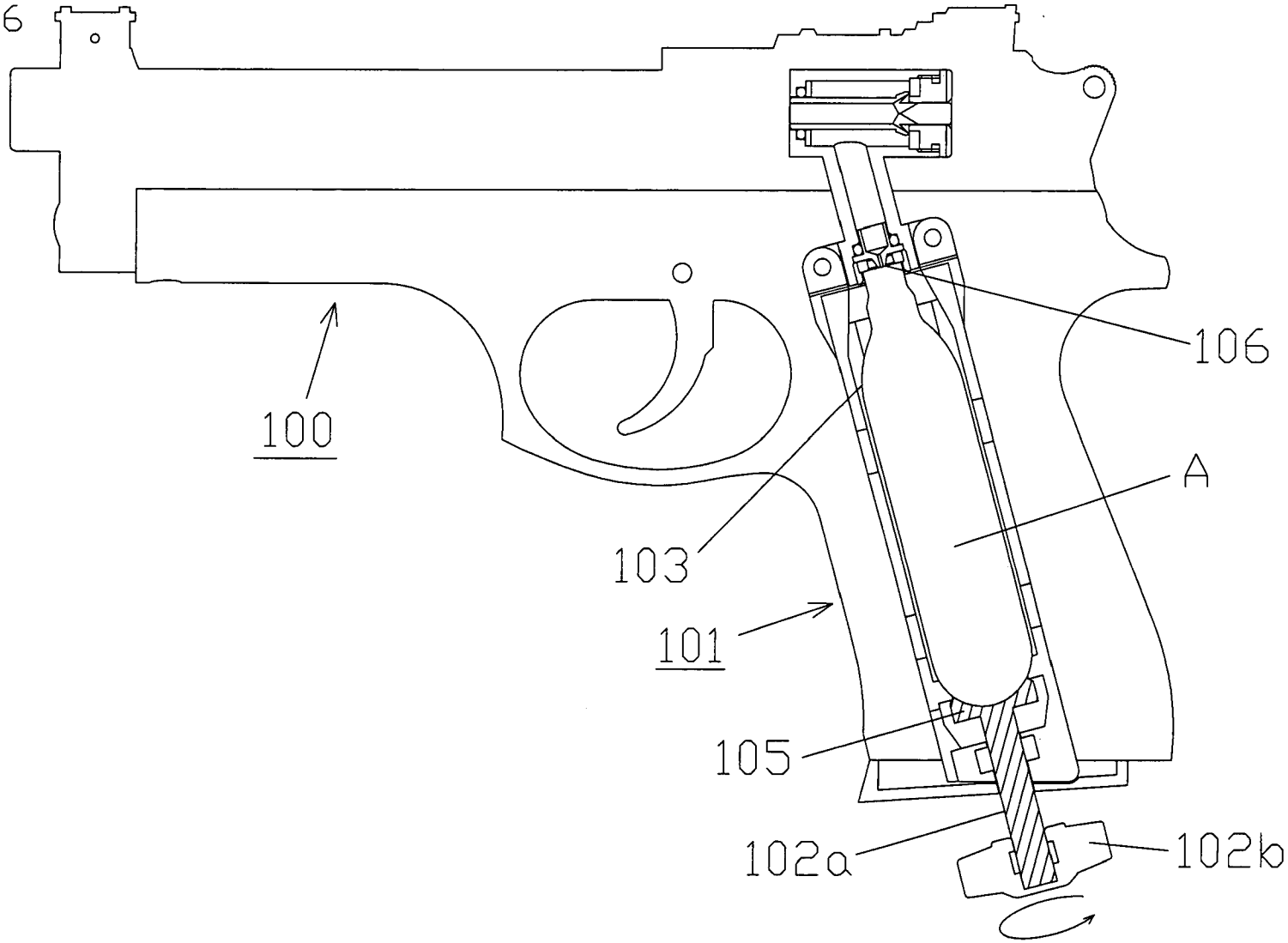
Figure 17:
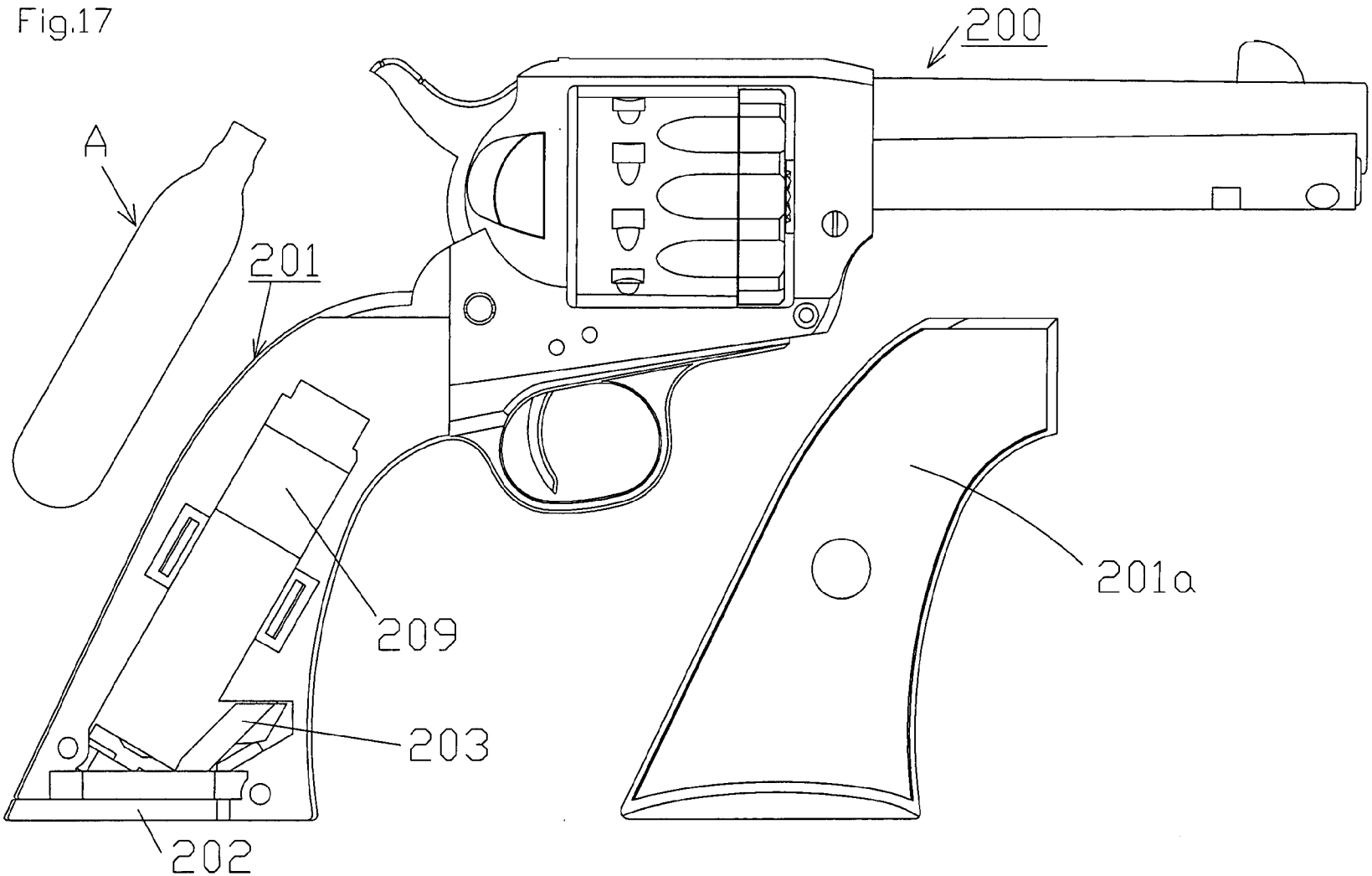
FIGS. 17 to 21 show high-pressure gas cartridge attachment and detachment apparatus relating to related art 2.
Figure 18:
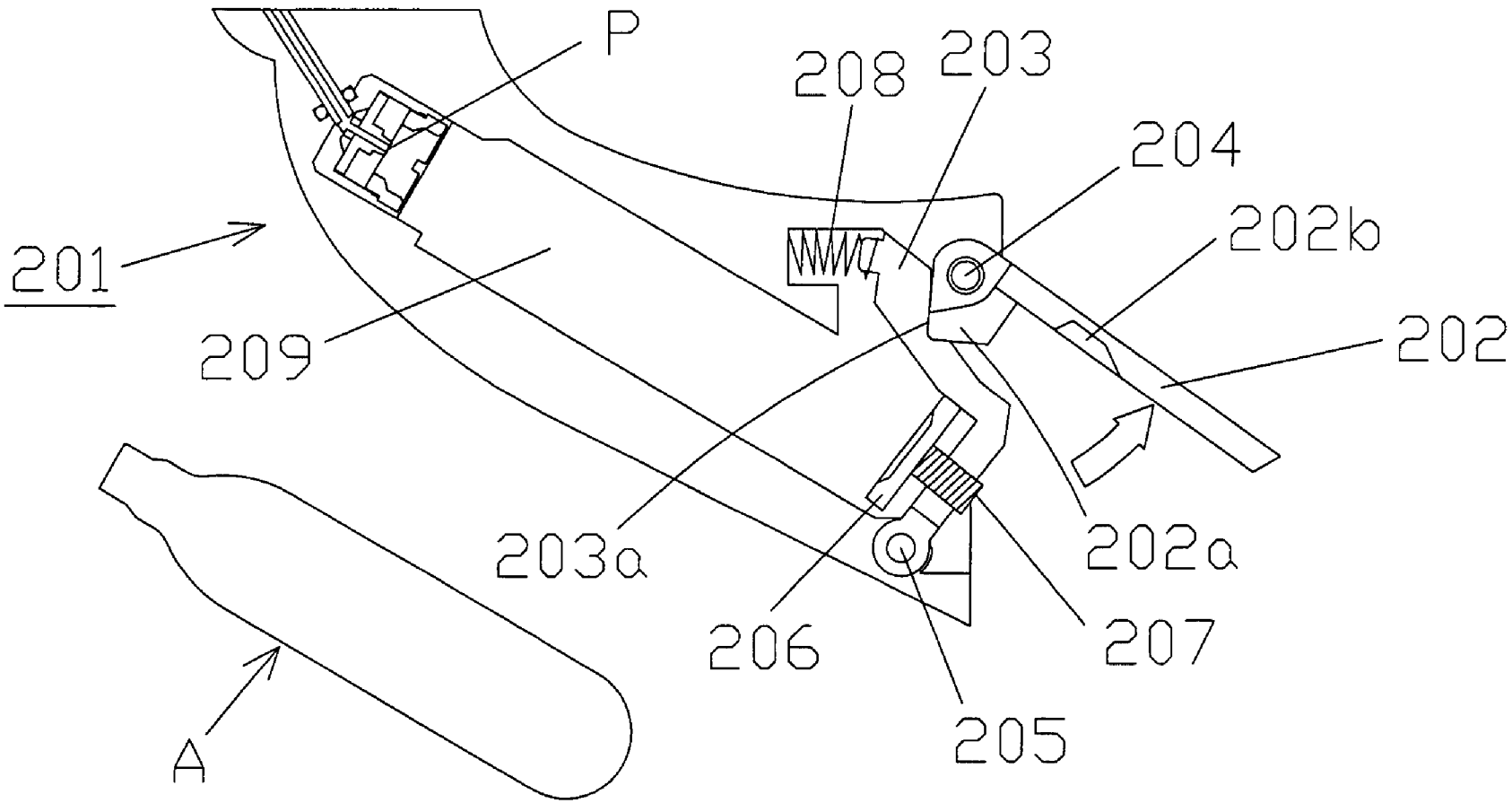
Figure 19:
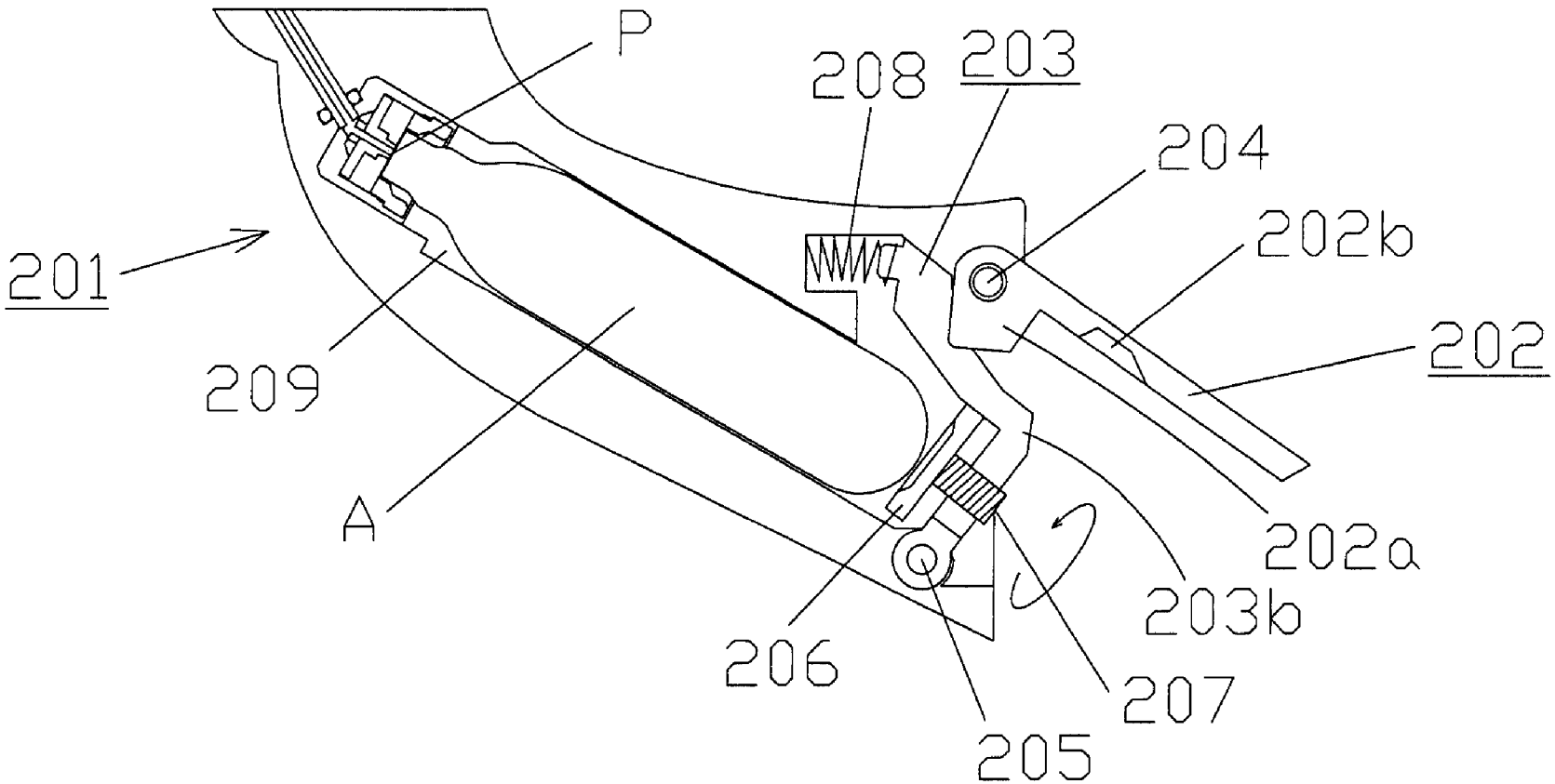
Figure 20:
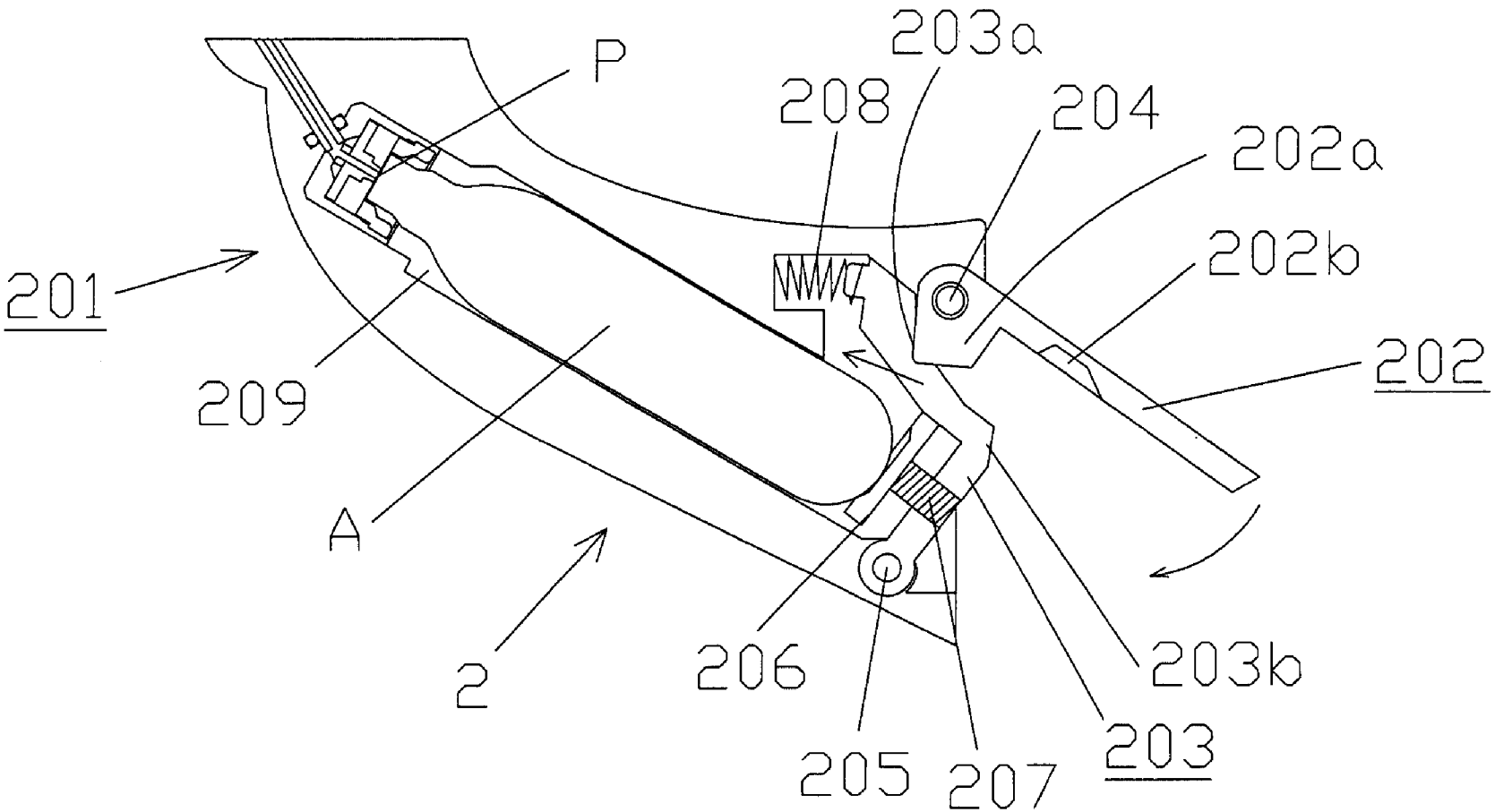
Figure 21:
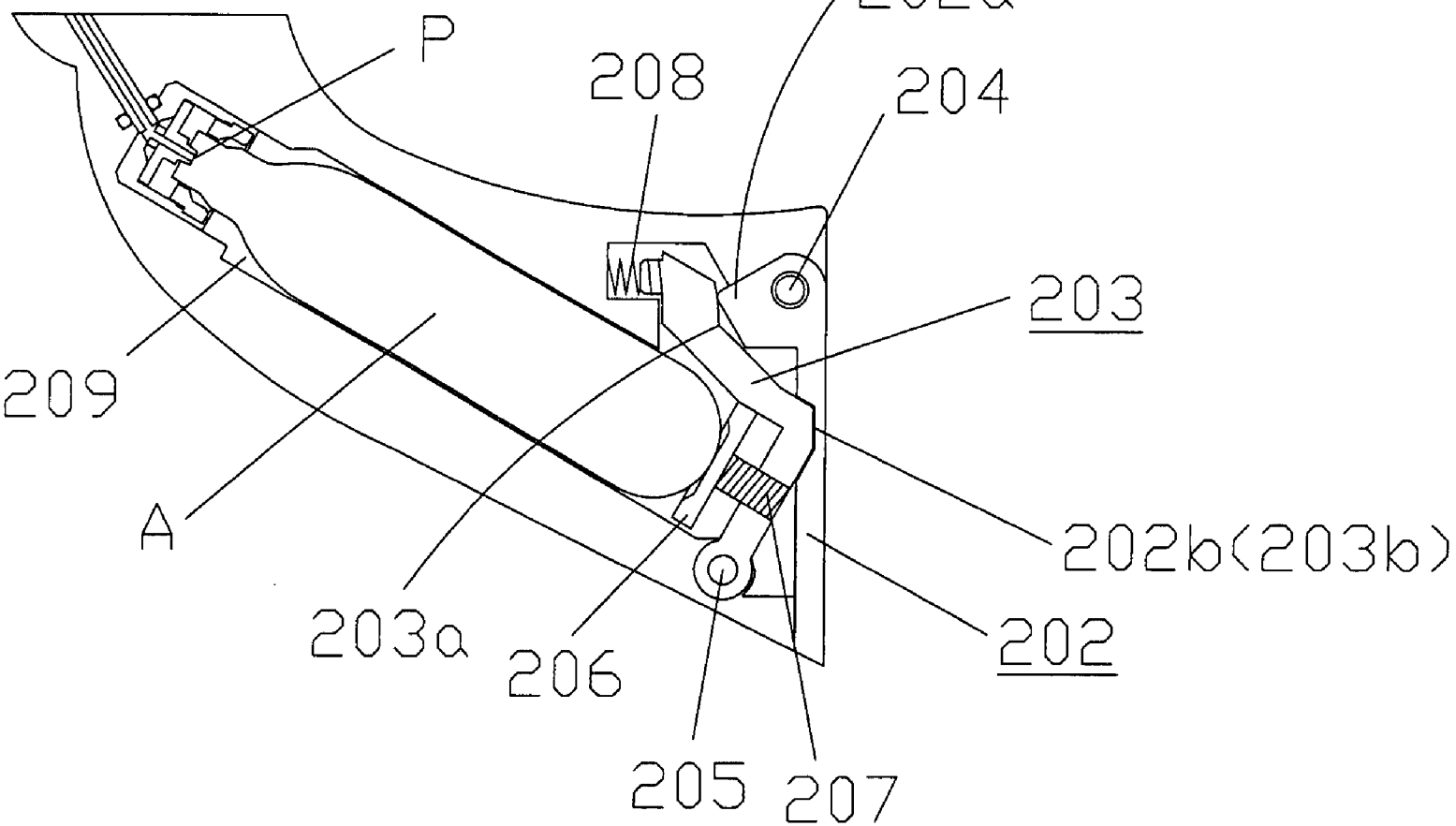

Next, the clamp lever 30 is rotated about the lever rotation axis 5 so as to become closed, as shown in FIGS. 9 and 10. The pressing curved surface 6 presses the bottom section A1 of the high-pressure gas cartridge A upwards due to the closing action of the clamp lever 30 so that the high-pressure gas cartridge A is clamped. The pressing curved surface 6 rotates and pushes up to a greater extent when constituted by a rotatable roller 6 and can be pressed up with a smaller force.

The clamp lever 30 is returned to the position of the back grip panel 3. When the clamp lever 30 is in a closed state, an upper end A2 of the high-pressure gas cartridge A is inserted into the pierce 9 so as to be opened as a result of the high-pressure gas cartridge A being pushed upwards within the clamped cartridge housing 2. As a result, high-pressure gas within the high-pressure gas cartridge A is supplied to a chamber 90 of the air gun G.

Further, the operation of extracting an empty high-pressure gas cartridge A from the cartridge housing 2 of the air gun G is the same as the housing operation. Finally, the side grip panel 10 is extracted, and the grip lever 30 of the back grip panel 3 is rotated about the lever rotation axis 5 so as to be opened. In doing so, the roller 6 constituting the pressing curved surface pushing up the high-pressure gas cartridge A within the cartridge housing 2 is extracted from within the cartridge housing 2. Because of this, the high-pressure gas cartridge A moves to the bottom surface side within the cartridge housing 2 due to its own weight or due to a manual operation by the user. The high-pressure gas cartridge A can be extracted from within the cartridge housing 2. In this state, the next high-pressure gas cartridge A filled with high-pressure gas is housed within the cartridge housing 2, and it is possible to soon use the air gun G by rotating the clamp lever 1 of the back grip panel 3 so as to cause closing.

According to the high-pressure gas cartridge attachment and detachment apparatus of an air gun of this invention, the clamp lever 30 is provided taking the back grip itself as the clamp lever. It is therefore possible to make the length of the clamp lever from the lever rotation axis 5 long compared to the related art. Because of this, the point of force of the operation becomes large even for the same force due to the rotation of the long lever, and rotation of the clamp lever 30 can be carried out in an extremely straightforward manner with a relatively small force compared to the related art.

According to a first embodiment of a high-pressure gas cartridge attachment and detachment apparatus for an air gun of this invention, the following results are obtained. This invention is capable of attachment and detachment of a high-pressure gas cartridge in a short period of time in an extremely straightforward manner with little force compared to high-pressure gas cartridge attachment and detachment apparatus of the related art.

Further, in this invention, the back grip panel 3 is formed from one piece in an L-shape with a substantial thickness. The total number of parts is therefore small compared with the related art and the structure and operation is straightforward. There are also very few negative influences with regards to the design of the grip.

What is claimed is:

1. A high-pressure gas cartridge attachment and detachment apparatus for an air gun comprising:

a high-pressure gas cartridge housing provided in a clip of an air gun;

a back grip panel for a grip formed as a clamp lever;

a lever rotation axis constituting a rotation fulcrum for the back grip panel; and a pressing curved surface capable of pressing a bottom part of a high-pressure gas cartridge, wherein the pressing curved surface comprises a rotatable roller;

wherein a side grip panel of the grip is provided in an attachable and detachable manner so as to open and close the high-pressure gas cartridge housing, the high-pressure gas cartridge is configured to be attached and detached with the back grip panel of the grip rotated about the lever rotation fulcrum so as to be in an open state, and the back grip panel is configured to press against the bottom of the high-pressure gas cartridge due to rotation centered about the lever rotation axis so as to be closed, wherein the rotatable roller is configured to move the high-pressure gas cartridge in a straight line toward a pierce when the back grip panel is closed.

2. A high-pressure gas cartridge attachment and detachment apparatus for an air gun comprising:

a high-pressure gas cartridge housing provided in a clip of an air gun;

a back grip panel for a grip formed as a clamp lever;

a lever rotation axis constituting a rotation fulcrum for the back grip panel; and a pressing curved surface capable of pressing a bottom part of a high-pressure gas cartridge, wherein the pressing curved surface comprises a rotatable roller;

wherein a side grip panel of the grip is provided in an attachable and detachable manner so as to open and close the high-pressure gas cartridge housing, the high-pressure gas cartridge is configured to be attached and detached with the back grip panel of the grip rotated about the lever rotation fulcrum so as to be in an open state, and the back grip panel is configured to press against the bottom of the high-pressure gas cartridge due to rotation centered about the lever rotation axis so as to be closed, wherein the back grip panel is configured to rotate about the lever rotation axis so that the roller is positioned outside of the high-pressure gas cartridge housing.

3. A high-pressure gas cartridge attachment and detachment apparatus for an air gun comprising:

a high-pressure gas cartridge housing provided in a grip of an air gun;

a side grip panel, wherein the side grip panel is attachable and detachable from the air gun so as to open and close the high-pressure gas cartridge housing;

a back grip panel that is configured to rotate about a lever rotation axis, wherein the back grip panel is configured to attach and detach a high-pressure gas cartridge when the back grip panel is rotated about the lever rotation axis; and a pressing curved surface of the back grip panel that is configured to press a bottom part of the high-pressure gas cartridge;

wherein the apparatus is configured so that an upper end of the high-pressure gas cartridge is pressed against a pierce while the back grip panel is closed, wherein the pressing curved surface comprises a roller that is configured to rotate freely.

4. A high-pressure gas cartridge attachment and detachment apparatus for an air gun comprising:

a high-pressure gas cartridge housing provided in a grip of an air gun;

a side grip panel, wherein the side grip panel is attachable and detachable from the air gun so as to open and close the high-pressure gas cartridge housing;

a back grip panel that is configured to rotate about a lever rotation axis, wherein the back grip panel is configured to attach and detach a high-pressure gas cartridge when the back grip panel is rotated about the lever rotation axis; and a pressing curved surface of the back grip panel that is configured to press a bottom part of the high-pressure gas cartridge;

wherein the apparatus is configured so that an upper end of the high-pressure gas cartridge is pressed against a pierce while the back grip panel is closed, wherein the pressing curved surface comprises a roller that is configured to rotate freely, wherein the roller is configured to rotate with respect to the back grip panel.

5. A high-pressure gas cartridge attachment and detachment apparatus for an air gun comprising:

a high-pressure gas cartridge housing provided in a grip of an air gun;

a side grip panel, wherein the side grip panel is attachable and detachable from the air gun so as to open and close the high-pressure gas cartridge housing;

a back grip panel that is configured to rotate about a lever rotation axis, wherein the back grip panel is configured to attach and detach a high-pressure gas cartridge when the back grip panel is rotated about the lever rotation axis; and a pressing curved surface of the back grip panel that is configured to press a bottom part of the high-pressure gas cartridge;

wherein the apparatus is configured so that an upper end of the high-pressure gas cartridge is pressed against a pierce while the back grip panel is closed, wherein the pressing curved surface is configured to move the high-pressure gas cartridge in a straight line toward a pierce when the back grip panel is closed.

* * * * *